United States Patent [19]

Williams et al.

[11] 4,051,276

[45] Sept. 27, 1977

[54] METHOD OF DEACIDIFYING PAPER

[75] Inventors: John C. Williams, Alexandria, Va.; George B. Kelly, Jr., Gaithersburg, Md.

[73] Assignee: The United States Government as represented by the Librarian of Congress, Washington, D.C.

[21] Appl. No.: 660,286

[22] Filed: Feb. 23, 1976

Related U.S. Application Data

[62] Division of Ser. No. 536,125, Dec. 24, 1974, Pat. No. 3,969,549.

[51] Int. Cl.[2] ..... C23C 11/00; C23C 13/00; B05D 3/02

[52] U.S. Cl. ..... 427/248 C; 21/7; 21/58; 162/160; 162/187; 264/81; 427/296; 427/316; 427/343; 427/395

[58] Field of Search ..... 264/81; 427/248 C, 296, 427/316, 343, 395; 21/7, 58; 162/160, 187

[56] References Cited

U.S. PATENT DOCUMENTS

| | | | |
|---|---|---|---|
| 2,957,785 | 10/1960 | Leatherland | 427/395 X |
| 3,472,611 | 10/1969 | Langwell | 427/395 X |
| 3,676,055 | 7/1972 | Smith | 427/395 X |
| 3,676,182 | 7/1972 | Smith | 427/326 X |
| 3,703,353 | 11/1972 | Kusterer et al. | 21/7 X |
| 3,771,958 | 11/1973 | Kusterer et al. | 427/395 X |
| 3,898,356 | 8/1975 | Williams et al. | 427/343 |

*Primary Examiner*—Michael R. Lusignan
*Attorney, Agent, or Firm*—Joseph A. Hill; Thomas J. Byrnes; A. David Spevack

[57] ABSTRACT

This invention relates to solutions of selected organo-metallic compounds dissolved in an organic solvent which are useful for deacidifying a cellulose fiber paper. The paper is treated by means well known in the art, such as dipping or spraying. The organo-metallic compounds useful in this invention are compounds which may be rapidly hydrolyzed to an alkaline material such as lower alkyl compounds of lithium, aluminum, magnesium, gallium, zinc, and mixtures of these compounds. The organic solvent is a liquid which will not react with the organo-metallic compound, dissolve inks, or cause discoloration of other materials usually found in and around printed matter. After the paper is impregnated with the solution the organo-metallic compound remaining on the paper is hydrolyzed to an alkaline material.

4 Claims, No Drawings

METHOD OF DEACIDIFYING PAPER

GOVERNMENT LICENSE

The invention described herein may be manufactured and used by or for the Government of the United States of America for Governmental purposes without the payment of any royalities thereon or therefore.

PRIOR APPLICATIONS

This application is a division of U.S. Pat. application Ser. No. 536,125 filed Dec. 24, 1974 now U.S. Pat. 3,969,549 patented July 13, 1976.

This invention pertains to a method of preserving paper and more particularly to a method of neutralizing the acidity of paper and buffering it to the alkaline side to improve its permanence.

BACKGROUND OF THE INVENTION

Certain early papers have lasted for over a thousand years and many papers made during the Middle Ages are still in excellent condition. Such paper made in the Middle Ages is still good and is expected to last for centuries, but modern paper becomes brittle and disintegrates within 5 to 75 years. The investigations of Barrow as reported in Permanence/Durability of the Book, Barrow Research Laboratories, Richmond, Va., 1963, and others have established that acid paper has a short life whereas paper which has a pH of 7 or slightly above will remain supple and not appear to age by discoloration.

Paper has been made on the acid side since the early years of the 19th century when the use of rosin/alum sizing was introduced. Even today, the major portion of the paper produced is of this acid sized paper. Libraries, therefore, are filled with books in which the paper is degrading at a rather rapid rate into a brittle, yellow dust. The Library of Congress itself has an estimated 6 million books which are already in such condition that they should not circulate and with minor exceptions the whole collection of the Library of Congress should be neutralized and buffered to halt degradation. For the Library of Congress alone, that would be 3,000 tons of books that require emergency treatment. The Library of Congress is not alone, and this same condition exists in almost every library of the United States and most foreign countries where the paper is manufactured with an acid sizing treatment. This phenomenum is easily observed in the Patent Office itself by viewing the degradation of the patents within the shoes. As one conducts a search, one finds that the patents become yellow and brittle as one proceeds back in date order to patents that are 25 years old and older.

Many methods have been devised for neutralizing the acid nature of paper, but most of these entail an individual or small batch treatment of paper in various solvents. Such prior methods and an improved small batch method itself are discussed in our co-pending application, Ser. No. 447,120 entitled "IMPROVED METHOD OF DEACIDIFYING PAPER" filed Feb. 28, 1974, now U.S. Pat. No. 3,898,356. These first methods, such as the one suggested by Barrow and discussed in our co-pending application, utilized various methods of dipping or spraying the buffering agent onto the paper. Such solvent and aqueous treatments are not adaptable to a mass method and may often leave a book warped and the paper cockled. With solvent based treatments, one must carefully test the materials to avoid destroying or damaging the inks and color values of prints contained within the books. All of these methods, both aqueous and solvent methods, can often be damaging to leather, plastic, or other binding materials as are commonly used to produce and bind modern books.

Some methods for the use of a volatile buffering or neutralizing agent have previously been suggested. Several volatile phosphorous compounds which are alkaline have been suggested, although these compounds are extremely toxic and would not be primarily useful in such a process unless the toxicity imparted to the paper impregnated with such material could be controlled or would not be a problem. Various persons have experimented with variations of the volatile/alkaline/nitrogen compounds such as ammonia and its related amines. Work on neutralization and buffering, using a vapor, has been reported by Langwell in U.S. Pat. No. 3,472,611, issued Oct. 14, 1969. In the Langwell method, an impregnated sheet or powder is interleaved between the pages of a book to be preserved and said book is stored for a period time to allow the penetration of the pages with the base material. The material itself is described as a non-deliquescent salt of a reaction product of a normally liquid mono-amine and an acid. The salts are usually acetates and carbonates of cyclohexylamine, diisopropylamine, piperdine, morpholine, or various butylamines. The method described by Langwell, of course, suffers from the problem that the amine will have a tendency to dissipate from the neutralized book over a period of time, allowing the natural acid conditions of the book and the atmosphere to return.

Kusterer, in U.S. Pat. No. 3,703,353, issued Nov. 21, 1972, described an impregnation of paper with hexamethylenetetramine wherein the hexamethylenetetramine is produced by reacting ammonia and formaldehyde in gaseous form to impregnate the paper. Kusterer, et al., in U.S. Pat. No. 3,771,958, issued Nov. 13, 1973, discloses a method of impregnating and neutralizing paper by exposing it to gaseous morpholine.

Another vapor method of treating paper is shown by Smith in U.S. Pat. No. 3,676,055, issued July 11, 1972. Smith does not neutralize the paper itself in a vapor method, but instead uses an alcoholic solution of magnesium methoxide to neutralize the paper and then introduces ethylene oxide, which is a well knwon fumigant agent, to fumigate the books against vermin and to improve the aging characterstics of the treated paper.

The Langwell paper deacidification has been discusssed by Dupuis, et al. in Restaurator, Volume I, No. 3, pp. 149–164, of 1970. The use of such compounds as the cyclohexylamine and morpholine suffer from the problem that the compounds themselves have an unpleasant odor and have a tendency to exude from the treated volumes over the course of time until they are totally dissipated. The various amines leave an unpleasant odor which is detrimental to their use.

OBJECTS OF THE INVENTION

The method of deacidifying and buffering paper which is our invention is intended to remove the problems of other vapor deacidifying techniques and provide in general for a method adaptable to large scale deacidification and buffering of books which will not entail individual handling each page or volume to accomplish the deacidification.

It is therefore an object of this invention that paper be uniformly neutralized.

It is a further object of this invention that paper should be buffered as close to a pH of 7 as possible on the alkaline side since higher pH values may cause tinting or changes in the color of inks and art work and yellowing of the paper made from ground wood.

An additional object of this invention is that paper should be given an alkaline reserve of a base material which is the equivalent of about 3% calcium carbonate as has been described in our co-pending application, 447,120, now U.S. Pat. 3,898,356, referred to hereinabove.

Another object of this invention is to provide a treatment which penetrates books and masses of books in a reasonable period of time.

Yet another object of this invention is to provide a treatment wherein the alkaline agent impregnated in the paper is "fixed" to the paper and will not dissipate therefrom.

An additional object of this invention is to provide a treatment which will leave the paper odor-free and not visibly cause color changes or materially effect inks or other materials within the paper or the bindings of the volume of paper.

In addition, an object of this invention is that the treated paper should be essentially non-toxic to humans.

Other objects of this invention will become apparent in the following description.

SUMMARY OF THE INVENTION

This invention contemplates a process of neutralizing the acidity of paper and buffering it on the alkaline side to improve its permanence. The method also contemplates either in the primary treatment or in a secondary treatment imparting vermin protection and destruction of existing vermin within the paper. The method in particular contemplates treatment of paper as it exists in books without causing any material damage to existing bindings, printing inks, or illustrations. This invention generally contemplates a method of deacidifying and buffering paper based on cellulosic fiber by impregnating the paper with the vapors of a volatile organo-metallic compound wherein said compound is capable of being hydrolyzed or decomposed to a base material. The preferred compounds are those organometallic compounds which will form a colorless solution of such metal alkyl compound, preferably aklyl compounds of lithium, aluminum, magnesium, gallium, zinc, and possibly cadmium, tin and antimony, although these past three are less satisfactory, because they can form highly colored sulfides in contact with contaminated atmospheres. The metal compounds may exist alone or in mixtures or combinations such as aluminum/magnesium/alkyl compounds and alkali or alkaline earth metal compounds.

The preferred metal alkyl compounds are those characterized by low air and moisture stability and a reasonably high vapor pressure. Most preferred are compounds with a vapor pressure of at least 1 mm Hg at the temperature of use. Such compounds include in part:

a. aluminum trialkyl wherein the alkyl group is a lower alkyl of 1 to 6 carbons. The metal alkyl compounds may be in the form of an etherate;
b. lithium alkyl wherein the alkyl is lower alkyl of 1 to 6 carbons. This class of compounds provides good protection when used in a dip or spray process, but is not a preferred choice because of low volatility. Some beryllium alkyl compounds meet the criteria for vapor phase action but are generally too toxic for use where the end product will be in close contact with persons, and
d. zinc, gallium and cadmium alkyls wherein the alkyl is lower alkyl of 1 to 6 carbons. Cadmium compounds tend to be toxic.

The most preferred compounds for use in the invention are diethylzinc, dimethylzinc, trimethyl-aluminum, tri-n-propylaluminum, tri-n-butylaluminum, tri-ethyl aluminum, di-n-propyl zinc, di-n-butyl-zinc, diisobutyl zinc.

The important criteria for the organo-metallic compound is: (1) that it be relatively volatile, whether at atmospheric pressure or under reduced pressure, at temperatures up to about 150° C.; (2) that it not cause discoloration of the paper, and (3) that it not interact significantly to damage inks or materials usually found in books, (4) that it be readily reactive with acids, and preferably also with alcohols and the hydroxyl groups of cellulose.

The organo-metallic compounds useful in this invention are not stable when in contact with the atmosphere and will decompose on contact with water vapor. The compounds are generally pyrophoric. The organo-metallic compound also probably reacts to form reaction products with the cellulose of the paper itself. These are later hydrolyzed by alcohol or moisture to deposit a weak base in the paper.

The essence of the invention is that the organometallic compound reacts with cellulose and is later hydrolyzed off using water or alcohol to deposit zinc or other metal oxide or hydroxide in situ. If it didn't react, the organometallic compound would be pulled out on further pumping or flushing with inert gas. However, we note that the novelty of the method does not depend on this explanation.

The fast degradation of cellulose occurs when it is on the acid side and amounts to hydrolysis or scission of the hemi-acetal bonds, and cutting of the chain.

On the alkaline side, degradation is much slower and probably proceeds by oxidation. Hydrogen and other peroxides form. Their attack on cellulose is catalyzed by transition metal compounds, iron, cobalt, nickel and copper. Oxidation of cellulose alcohol to carbonyl groups leaves the cellulose unstable and prone to color change. There are a number of anticatalysts for the oxidation, including magnesium compounds at pH values above 9.5 which are reported to stabilize $H_2O_2$ and iodide compounds which are reported to rapidly decompose $H_2O_2$.

The most preferred of the organo-metallic compounds are the lower alkyl compounds of zinc, and in particular diethyl zinc and dimethylzinc. These compounds react readily with the hydroxyl groups of the cellulose. The reaction product will hydrolyze in the presence of moisture to regenerate the cellulose and form zinc oxide. Zinc oxide is an innocuous paper-loading material which is already widely used in copying papers.

In general, the method of this invention entails placing the paper or documents to be treated in a vacuum chamber, reducing the pressure of said chamber, and maintaining a low pressure until the effluent from the chamber is substantially devoid of water vapor. It is preferred that the books themselves be essentially or substantially dry when they are treated so that the cellulose organo-metallic compound will form under controlled conditions. After the chamber is evacuated and or flushed with a non-reactive gas, an organo-metallic compound may be introduced either directly as a vapor or saturated into a neutral or non-reactive gas. Such gases as carbon dioxide, nitrogen, or inert gases such as argon are useful for this purpose. The organo-metallic compound may also be introduced as a liquid and subsequently volatilized in the chamber. The paper is allowed to remain in contact with the organo-metallic vapors for time sufficient for the vapors to penetrate and impregnate the papers present in the chamber. The particular time necessary for said impregnation will vary depending on the volume of material being treated, the size of the vacuum chamber, the porosity of the paper or other material and other variables which are easily discernible to a person of ordinary skill in the art. After the paper has been sufficiently exposed to the organo-metallic vapors, the excess reactive vapor is removed by a vaccum pump to a condenser, or the vapor chamber is flushed with a neutral or non-reactive gas. Then a nonreactive gas containing a quantity of moisture or other reactive material is introduced into the chamber. The addition of the reactive material to the gas may be efficiently done by such techniques known to persons of ordinary skill in the art as bubbling carbon dioxide, nitrogen or another non-reactive gas through water, alcohol, or other reactant sufficiently to saturate the gas. Sufficient water vapor or reactive materials should be introduced into the vacuum chamber to interact with the available organo-metallic material. The exact amounts are determined by the usual calculation known to one of skill in the art based on the weight of the gas used.

After sufficient time has elapsed for a complete interaction in situ between the organo-metallic compound and the reacting agent, such as water vapor, alcohol, or ammonia, the chamber is flushed with air to remove any toxic or flammable products and returned to atmospheric conditions and the treated paper removed from the chamber.

A number of reactions occur when the cellulose paper is treated with diethylzinc as an example of a organo-metallic compound.

a. The diethylzinc reacts with any residual moisture in the paper.

$$(C_2H_5)2\ Zn + H_2O \rightarrow (C_2H_5)ZnOH + C_2H_6\uparrow$$

$$(C_2H_5)\ ZnOH + H_2O \rightarrow C_2H_6\uparrow + Zn(OH)_2$$

This deposits the alkaline $Zn(OH)_2$ in the paper.

b. The diethylzinc reacts with the hydroxyl groups on cellulose (cell).

$$\text{Cell OH} + (C_2H_5)\ Zn \rightarrow \text{Cell OZn}(C_2H_5) + C_2H_6\uparrow$$

When moisture or alcohol meets the reacted cellulose in the second step of the reaction, the zinc is hydrolyzed off as follows:

$$\text{Cell O Zn}—(C_2H_5) + 2H_2O \rightarrow \text{Cell OH} + Zn(OH)_2 + C_2H_6\uparrow$$

This deposits alkaline $Zn\ (OH)_2$ in the paper.

c. Aldehyde groups are well known to cause color change and rapid degradation in cellulose. Diethylzinc reacts with these to produce stable alcohols, as follows:

$$\text{Cell CHO} + (C_2H_5)_2Zn \rightarrow \text{Cell } CH_2OH + Zn(OH)_2 + C_2H_6$$

$$[\text{Cell}]_2\ C{=}O + (C_2H_5)_2Zn \rightarrow [\text{cell}]_2{=}CHOH + Zn(OH)_2 + C_2H_6$$

These reactions change cellulose from an unstable to a stable material, one showing good color retention.

The acid present in the paper is neutralized by a typical reaction of the metal alkyl compound with an active hydrogen.

$$AlR_3 + 3HX \rightarrow AlX_3 + 3RH$$

Where R is a lower alkyl, particularly those lower alkyl groups wherein the end side product RH is a gas.

In a large scale or commercial operation, a particular advantage of this process is that volumes to be treated are packed into a non-reactive container at the Library. It is only necessary that the boxes be readily permeable to the vapors of the organic material. The boxes are then sealed at the Library, transported to the treatment center, and stored there preferably in a dry room to help reduce any ambient moisture which would be occluded in the packing boxes or the volumes themselves. The volumes in the packing box or other carrier are treated in vacuum chambers such as the ones utilized in the space program which are able to treat 5,000 or more volumes at one time. After treatment, the books can be returned to the Library in the original container. This has the advantage of reducing the amount of handling of the books and reducing security problems since the books themselves need be handled only by the Library personnel.

The treating times may vary from less than one hour with treating agents of high vapor pressure such as dimethylzinc to 24 hours or more with treating agents of very low vapor pressure such as tri-n-butylaluminum.

In general low temperatures are desirable, preferably room temperature, due to the great difficulty in uniformly heating a large mass of books to insure uniform penetration and reaction.

The organometallic compounds may be used alone or in mixtures and may be diluted with unreactive solvents such as ether, heptane, or xylene. It is important that the vapor pressure of the solvent is not greatly lower than that of the organometallic agent at the temperature of treatment, to insure that an adequate vapor concentration of the organometallic agent is obtained. In the case of diethylzinc, octane is a satisfactory diluent. The use of diluted agents provides increased safety in the handling of the agent. At concentrations of 10 to 15% diethylzinc in octane, the pyrophoric nature of the diethylzinc is restrained, and while the dilute solution may smoke vigorously, it generally does not ignite spontaneously. However, the solution must be handled carefully, as it is still extremely flammable. The organometallic agents require protective clothing and equipment in handling as they cause very serious skin burns even in the dilute solutions, and the vapors and smoke are irritating to the lungs and eyes.

The limits on the process are set by the physical properties of the materials involved. Thus, the maximum temperature used must be below the decomposition temperatures of the components of the books and papers and the decomposition temperature of the organometallic treating agent. An exposure of paper to temperatures above 150° C will result in significant deterioration of the paper in a few hours so this in general represents the upper limit of temperature. However, most organometallics used in this process have decomposition temperatures lower than this, which will effectively lower the upper operating limit to that of the decomposition temperature of the organometallic treating agent. In the case of diethylzinc, this decomposition begins at about 120° C, or slightly below its boiling point at atmospheric pressure.

The preferred upper operating limit is about 80° C which will provide an adequate margin of safety.

The pressure used in the treatment is limited by the vapor pressure of the organometallic treating agent and the length of time permissible for treatment. The pressure must be low enough to insure adequate volatilization of the treating agent and provide a reasonable vapor concentration. Thus pressures below about 1 to 2 mm of mercury absolute will require unreasonably long treating times, and the upper pressure limit is substantially atmospheric pressure, although there is no reason why superatmospheric pressures could not be used if suitable vapor concentrations could be maintained. In general, a minimum vapor pressure of about 1 mm at the temperature employed is necessary for impregnation in a reasonable time, but it is preferred that the vapor pressure of the organometallic be at least 10 mm in the treating chamber.

A typical treatment is described. The apparatus is a heated vacuum chamber with a reflex condenser and a pump which can be operated at 0.05 mm of mercury absolute pressure. Dry nitrogen or dry carbon dioxide is provided for purging the equipment.

The material to be deacidified is weighed and placed in the chamber and heated to 60° C while evacuating to a pressure of less than 0.1 mm of mercury absolute. When the material hs dried to the point that the pressure remains steady for 20 minutes with the pump shut off (this also insures against leaks) the treatment is begun. Any moisture in the books and papers being treated in volatized under the temperature and pressure utilized, otherwise it would inhibit the penetration of the agent, causing reaction to take place in the outer sheets and edges of the objects being treated leaving the center unchanged in acidity or inadequately treated unless the treatment is prolonged and a large excess of the treating agent is employed. In any case, such excess moisture leads to uneven distribution of the alkaline reserve imparted to the paper by the treatment, and is thus undesirable. It is advantageous to heat the books and papers slightly to prevent condensation.

The organometallic compound (in this case, diethylzinc) is injected into the chamber, avoiding contact of the liquid with the paper. The diethylzinc volatizes under the conditions of heat and low pressure. An amount of diethylzinc is used sufficient to leave about 3% of zinc oxide in the weight of books and papers charged, or about 47 grams of diethylzinc for each kilogram of paper or books.

Neutralization of the paper is extremely rapid and is accomplished in a few minutes but exposures of 30 minutes to several hours are necessary for complete reaction to achieve a reasonable alkaline reserve in the paper or books.

After treatment, the chamber is purged with dry nitrogen and any excess of the treating agent destroyed with a small amount of alcohol or water. This treatment also hydrolyzes the cellulose organo-metallic compound and deposits zinc oxide in situ. The chamber can then be opened and the book safely removed. Any residue of alcohol or diluent vapor left in the books diffuses away rapidly, particularly if the books are left in a current of air for a few hours after being removed from the chamber. Alternatively, the books can be subjected to a second evacuation in the chamber to remove the vapors.

With this method, papers have been impregnated with zinc oxide at levels ranging from 0.5% to as much as 9.6%. Typical examples of impregnation obtained in a single treatment with nine different papers in a one-hour exposure to diethylzinc are shown in Table I. From the table, it can be seen that all the papers were effectively deacidified and given an alkaline reserve of zinc oxide. The papers vary significantly in the amount of zinc oxide absorbed, which is attributed to variation in the porosity and composition of the papers. Greater concentrations of zinc oxide can be achieved by longer or multiple exposures and higher concentrations of diethylzinc vapor in the treating chamber.

Pure diethylzinc vapor was found not to harm paper in the method of this invention.

TABLE I

Impregnation of Papers with Diethyl Zinc Vapor Phase-One Hour Treatment

| Paper | pH Before Treatment | pH After Treatment | % Zinc Oxide in Paper After Treatment |
|---|---|---|---|
| Newsprint | 5.4 | 7.8 | 0.89 |
| Offset Paper (LCIB) | 5.8 | 7.9 | 2.02 |
| Made Rite Offset | 5.6 | 8.2 | 1.48 |
| Whatman Filter Paper #1 | 6.6 | 8.1 | 0.94 |
| 100% Rag Ledger (GPO#773) | 6.2 | 8.0 | 1.37 |
| Old Book Paper (Rag) Published 1820 | 5.3 | 8.1 | 0.79 |
| Berestoke Text (Handmade) | 4.7 | 7.6 | 1.42 |
| Crane's Distaff Linen, Antique Laid | 5.2 | 7.7 | 0.54 |
| Mead Bond | 5.9 | 7.7 | 0.82 |

Several of the ipregnated papers were subjected to accelerated aging tests in both the dry and humid ovens to demonstrate the effectiveness of the treatment in preserving the paper.

Table II shows the effect of the treatment on accelerated aging in the dry oven at 100° C. The newsprint apparently was not improved by the treatment when tested in the dry oven, but the Mead Bond and the offset paper show substantial gains in fold retention as a result of the treatment. The brightness was not affected by the treatment at this level of impregnation. Higher levels of impregnation do result in improved brightness.

TABLE II

Diethyl Zinc Vapor Phase Treatment of Paper Effect on Accelerated Aging Characteristics Dry Oven Aging-100° C

| Paper | Equivalent Years Aging | Characteristics: MIT Folding Endurance* Control | MIT Folding Endurance* Treated | Brightness Control | Brightness Treated |
|---|---|---|---|---|---|
| Newsprint | Zero-Start | 118 | 135 | 54 | 53 |
| | 67 Years | 2.3 | 3.2 | — | — |
| | 117 Years | 1.5 | 1.7 | 40 | 41 |

TABLE II-continued

Diethyl Zinc Vapor Phase Treatment of Paper
Effect on Accelerated Aging Characteristics
Dry Oven Aging-100° C

| Paper | Equivalent Years Aging | Characteristics: MIT Folding Endurance* Control | MIT Folding Endurance* Treated | Brightness Control | Brightness Treated |
|---|---|---|---|---|---|
| Mead Bond | Zero-Start | 465 | 476 | 84 | 83 |
| | 67 Years | 64 | 274 | 77 | 77 |
| | 117 Years | 25 | 92 | 75 | 76 |
| Offset Gov't | Zero-Start | 604 | 652 | 76 | 75 |
| Printing Office | 67 Years | 207 | 432 | 71 | 71 |
| JCP-A60 | 117 Years | 20 | 252 | 70 | 70 |

*½ Kg load.

The results for the humid oven aging are shown in Table III. Surprisingly the treatment shows up quite well on newsprint in the humid aging oven. The other two papers also show the significant retention of fold endurance in humid oven aging as they did with the dry oven aging.

TABLE III

Diethyl Zinc Vapor Phase Treatment of Paper
Effect on Accelerated Aging Characteristics
Humid Oven Aging-90° C, 50% R. H.

| Paper | Equivalent Years Aging | Characteristics: MIT Folding Endurance* Control | MIT Folding Endurance* Treated | Brightness Control | Brightness Treated |
|---|---|---|---|---|---|
| Newsprint | Zero-Start | 118 | 135 | 54 | 53 |
| | 67 Years | 3.5 | 60 | 41 | 45 |
| | 117 Years | 0.6 | 36 | 36 | 41 |
| Mead Bond | Zero-Start | 465 | 476 | 84 | 83 |
| | 67 Years | 92 | 134 | 77 | 78 |
| | 117 Years | 54 | 122 | 75 | 74 |
| Offset Gov't | Zero-Start | 604 | 652 | 76 | 75 |
| Printing Office | 67 Years | 240 | 441 | 72 | 69 |
| JCP-A60 | 117 Years | 145 | 315 | 70 | 68 |

*½ Kg load.

We do not know exactly why the newsprint shows the difference in aging characteristics between the dry and humid aging oven. However, since the low humidity existing in the dry aging oven would not be experienced in normal aging except for a library in desert areas, it is believed that the treatment will be beneficial even for newsprint under all reasnable storage conditions. In the humid oven there appears to be some slight loss in brightness for the treated offset paper but the Mead bond is unaffected in brightness and the newsprint actually shows a significant improvement. The diethlzinc vapor-phase treatment thus gives a true mass vapor-phase deacidification effective for a mild bulk treatment of books, not only to neutralize acidity but also to produce a significant alkaline reserve in the books with little or no loss of brightness.

Although the main thrust of the method described herein is the advantages of using these compounds in vapor form for mass treatment, it should also be recognized that these compounds are useful in organic solvents for individual treatment methods known in the art, such as dipping and spraying.

It is also recognized that additional treatments can be accomplished on paper simultaneously with or following the treatment with the organo-metallic compound, particularly the paper can be exposed to various vapors which will impart protection against vermin such as fungi, insects, etc. This vermin treatment can be affected by exposing the paper to the vapors of ethylene oxide as is known in the art or to the vapors of various compounds such as those reported in the Sporicidal Effects of Vapors of Ring Polychlorinated Pyrimidines; study of physical factors effecting toxicity; Geshon and Parmagaiane, Transactions of New York Academy of Sciences, Volume 25, pp. 638–645, April, 1963.

Zinc oxide has been used as a fungistat in paints for may years, and it will function similarly in paper. Further, the vapors of the organo-metallics are toxic to many forms of vermin, thereby providing a side benefit during treatment, although the spore forms of some bacteria appear to be resistant and would require treatment with another agent such as ethylene oxide for complete sterilization of the books and papers.

DESCRIPTION OF THE PREFERRED EMBODIMENTS

Now having generally described the method of this invention in general terms, the following examples are set forth to more particularly illustrate the invention.

EXAMPLE 1

16 sheets of a 60-lb bond paper and 16 sheets of newsprint, 8½ × 11 inches, were placed in a treating chamber as described above and dried by heating to 68° C, while evacuating to a pressure of 0.1 Torr. After three hours, the pressure stabilized at 0.1 Torr and this pressure held for twenty minutes with the pump shut off. Then 20 ml of a 15% solution of diethylzinc in octane was injected into the treating chamber. The pressure rose immediately to about 90 Torr and reflux was noted from the condenser at the top of the chamber. Treatment was continued for 4½ hours at a pressure of 88–90 Torr and a temperature of 68–70° C. At the end of this period, the heat was shut off and the apparatus cooled to about 60° C, at which time the apparatus was returned to atmospheric pressure with dry nitrogen, and 4 ml of methanol was injected to destroy any excess diethylzinc. After 10 minutes, the reactor was opened and the treated sheets removed. The results are shown in Table IV.

TABLE IV

| Bond Paper | Untreated | Treated Sheet #1 (Top of Pile) | Treated Sheet #16 (Center of Pile) |
|---|---|---|---|
| pH | 5.3 | 7.7 | 7.65 |
| % ZnO | 0 | 0.81 | 0.62 |
| Newsprint | | Sheet #17 (Center of pile) | Sheet #32 (Bottom of Pile) |
| pH | 4.85 | 7.65 | 7.65 |
| % ZnO | 0 | 0.58 | 0.81 |

This shows the excellent penetration obtained in the impregnation.

Accelerated aging tests in the dry oven at 100° C indicated that the life of the bond paper was more than doubled by the treatment. As mentioned previously, little change in the estimated life of the newsprint was noted in the dry oven tests as a result of the treatment. However, in the humid oven tests, at 90° C and 50% R. H., the fold endurance retention of the newsprint was increased four times by the treatment (from 100 years to 430 years). The bond paper again showed a doubling of its retention of folding endurance under the humid aging conditions as a result of the treatment (242 years to 475 years).

EXAMPLE 2

A book segment measuring 19 cm × 7.5 cm × 4 cm thick with pages having pH of 5.0 to 5.6 and acidity of about 40 meq/Kg was placed in the treating chamber in a closed position. The weight of the book was 462 g. before drying. The book was dried in the treatment chamber for 4 hours at 65° C while evacuating to a pressure of 0.07 Torr. At this time, no further water could be drawn off from the book and the pressure stabilized. Then 65 ml of a 28% solution of diethylzinc in octane was injected, raising the pressure to 85 Torr. Slow reflux of the treating solution was maintained for 5½ hours keeping the temperature at 66°–69° C and the pressure at 85–86 Torr. At the end of this time, the reactor was cooled and backpressured with dry nitrogen to atmospheric pressure. The reactor was then purged with slightly damp nitrogen for 2 hours to destroy excess diethylzinc. The reactor was then opened and the book removed. Indicator tests with a pH pencil taken on pages 2, 59, 130, 451, 670, and 951 (last page) showed that the book was completely deacidified, with a slightly alkaline pH from the edge of the page clear to the spine. Tests of three pages taken from the front, center, and ¾ through the book showed pH measurements of 7.38, 7.35, and 7.35 respectively and zinc oxide contents of 0.36%, 0.38% and 0.39% respectively showing the excellent penetration and even distribution obtained. The brightness of the pages averaged 65.8 for the pages of the book before treatment and 64.6 for the pages after treatment, a negligible change for such a treatment. There was no change in folding endurance of the sheets as a result of the treatment. Since this book still had its covers, and with tightly closed, it is obvious that the penetration and neutralization is extremely effective and will not require the books to be opened for treatment.

EXAMPLE 3

16 sheets of newsprint 8½ × 11 and 16 similar sheets of offset paper JCP-A60 obtained from the Government Printing Office, weighing 61 and 66.6 g respectively before drying were carefully dried in a vacuum oven. After drying the sheets weighed 47.2 g (newsprint) and 62.9 g (offset).

The dried sheets of the two papers were placed in the treatment chamber in a single pile, and the chamber was heated to 60° C internal temperature while reducing the pressure in the chamber to 0.1 Torr. After 2 hours, to allow the paper to come to temperature equilibrium with the chamber, the pressure in the chamber was raised to 85 Torr with dry nitrogen, and 20 ml of a 25% solution of diethylzinc in octane was added to the bottom of the chamber, avoiding contact with the paper. Under these conditions, the octane and diethylzinc mixture boiled, filling the chamber with vapor. A condenser at the top of the chamber condensed the vapor and returned the condensate directly to the boiling solution in the bottom of the chamber, maintaining an effective concentration of diethylzinc vapor in the chamber.

The chamber was maintained at a temperature of 60° to 66° C and a pressure of 85 Torr for 1.5 hours, with a slow but steady reflux from the condenser during this time. The heat was then shut off and the chamber cooled, repressurized to atmospheric pressure and purged with slightly moist nitrogen for three hours to destroy any excess diethylzinc.

The papers were removed, the chamber drained to remove the residual octane and the slight octane residues evaporated to prepare the chamber for a second treatment.

The papers were returned to the chamber and the impregnation was repeated with another 20 ml of 25% diethylzinc solution following the above procedure. The newsprint from the first exposure averaged 0.75%, and 1.61% ZnO after the second exposure. The offset paper averaged 0.8% and 1.5% ZnO for the single and double exposures respectively. Thus, the amount of zinc oxide deposited may be increased by multiple exposures. The properties of the double treated paper, compared to those of the untreated controls, are shown in Table V.

TABLE V

| | pH | Alkalinity Meg/Kg | Bright-ness | MIT FOLD Endurance ½ Kg load MD* | MIT FOLD Endurance ½ Kg load CB** |
|---|---|---|---|---|---|
| JCP-A60 Offset paper, control (untreated) | 5.4 | — | 72.5 | 1135± 240 | 420± 116 |
| JCP-A60 Offset paper double treated with DEZ | 7.7 | 88 | 73.5 | 839± 224 | 364± 139 |
| Newsprint, Control (Untreated) | 5.1 | — | 54.4 | 193± 58 | 31± 11 |
| Newsprint, double treated with DEZ | 7.7 | 88 | 52 | 199± 27 | 59± 25 |

(±figures after MIT fold values are standard deviations)
*Folds machine direction
**Folds cross direction It can be seen from these tests that the papers were completely deacidified and left with a significant alkaine reserve, with no serious detrimental affects, even with the double treatment. After accelerated aging tests for 3, 6 and 12 days, the following results (Table VI) were observed on the treated and control papers.

TABLE VI

| Dry Oven Aging at 100° | 3 days | | 6 days | | 12 days | |
|---|---|---|---|---|---|---|
| | MD* MIT Fold | Bright ness | MIT Fold | Bright ness | MIT Fold | Bright ness |

TABLE VI-continued

| | | | | | | |
|---|---|---|---|---|---|---|
| JCP-A60 Offset paper, untreated control | 354 | 69.3 | 203 | 69.6 | 33 | 68 |
| Double DEZ Treatment | 657 | 71.0 | 322 | 69.8 | 205 | 66 |
| Newsprint, Untreated control | 7 | 46 | 3 | 42.6 | 0.5 | 35 |
| Double DEZ Treatment | 46 | 43 | 10 | 42.0 | 1.6 | 40 |

Humid Oven Aging at 90° C & 50% R. H.

| | 3 days | | 6 days | | 12 days | |
|---|---|---|---|---|---|---|
| | MD MIT Fold | Bright ness | MIT Fold | Bright ness | MIT Fold | Bright ness |
| JCP-A60 Offset paper, untreated control | 641 | 70.4 | 391 | 69.2 | 130 | 68 |
| Double DEZ Treatment | 701 | 70.0 | 652 | 66 | 337 | 64 |
| Newsprint, Untreated Control | 54 | 46.1 | 8 | 44 | 0.9 | 38 |
| Double DEZ Treatment | 65 | 46.2 | 48 | 42 | 41 | 40 |

*Folds machine direction

It can be easily seen that the double treatment has resulted in a substantial retention of folding endurance compared with the untreated controls. Even the newsprint shows a slight benefit from the double treatment in the dry aging tests, and both papers show a very great benefit in the humid aging tests.

EXAMPLE 4

Newsprint and JCP-A60 offset papers were impregnated with diethylzinc in a single exposure following the procedure outlined in Example 3 up to the point where the heat was turned off. At this point, the treatment chamber was cooled and repressurized slowly with gaseous ammonia. This has the dual advantage of destroying the excess diethylzinc and of converting the zinc compound deposited in the paper to an amine complex which improves the distribution of the zinc in the paper.

Surprisingly, the combination of zinc and ammonia was effective in retaining significant folding endurance in newsprint when exposed to dry oven accelerated aging as shown below in comparison with untreated control. The other paper also showed increased permanence as a result of the treatment, the results of which are as shown in Table VII.

TABLE VII

| | Dry Oven | | | | |
|---|---|---|---|---|---|
| | 0 Days / | 3 Days / | 6 Days / | 12 Days / | Fold,MD 36 Days |
| Newsprint Untreated control | 193 | 7 | 3.3 | 1.6 | 0 |
| Newsprint Treated with DEZ&$NH_3$ | 134 | 56 | 18 | 3.1 | 1.0 |
| JCP-A60 Untreated control | 1135 | 354 | 203 | 38 | 1.5 |
| JCP-A60 Treated w/ DEZ & $NH_3$ | 1012 | 644 | 411 | 271 | 10.2 |
| | Humid Oven | | | | |
| Newsprint Untreated control | 193 | 54 | 8.4 | 0.9 | 0 |
| Newsprint Treated with DEZ & $NH_3$ | 134 | 81 | 94 | 51 | 18 |
| JCP-A60 Untreated control | 1135 | 641 | 391 | 130 | 3.1 |
| JCP-A60 Treated w/ DEZ & $NH_3$ | 1012 | 475 | 479 | 303 | 59 |

EXAMPLE 5

Vapor Treatment with Trimethyl Aluminum

A packet of papers 8½ × 11 inches in size consisting of 36 sheets of 50 lb. basis wt. offset paper with a total weight of 150 grams was placed in the treatment chamber and dried under vacuum at 65° C. After 5 hours the pressure had dropped to 0.1 Torr, indicating substantial dryness. Then 5 ml of trimethyl aluminum was injected into the chamber, taking care that none contacted the paper in the liquid state. Litle change in pressure or temperature was noted, but reflux from the condenser started immediately. Reflux was continued for two hours, after which the heat was shut off, the reactor cooled, and the pressure returned to atmospheric by back filling with nitrogen. The excess triethylaluminum was destroyed with a few ml of methanol, and the papers removed. A comparison of the papers before and after treatment is shown in Table VIII.

TABLE VIII

| | Before Treatment | After Treatment |
|---|---|---|
| pH | 6.0 | 7.2 |
| Acidity | 10 meq/Kg alkalinity | 0.4 meq/Kg |
| Fold Endurance MD 718 | | 730 |
| CD 483 | | 617 |
| Brightness | 76.1 | 75.0 |

It can be seen that the paper was completely deacidified by the treatment, and a small amount of alkaline reserve instilled.

EXAMPLE 6

A packet of four different papers, a 70 lb. kraft paper, newsprint, rag handsheets, and 50 lb. offset paper, total weight 70.6 g, was placed in the chamber and evacuated at room temp (25° C) for six hours to a pressure of 0.1 Torr. At this time a stable pressure was established. Then 10 grams of diethylzinc was added, which raised the pressure to 15 mm. Slight reflux was obtained from the condenser on the chamber. The condenser was operated at 10° C while the chamber was maintained at 25° C and 15 Torr pressure. After 5 hours there was no further evidence of reflux or liquid in the chamber. The chamber was backfilled with nitrogen to atmospheric pressure and purged. There was no evidence of excess diethylzinc in the purge gas effluent. The chamber was then opened and the papers removed. The papers analyzed as shown in Table VIII.

TABLE VIII

| | Kraft | | Newsprint | | Rag Handsheets | | Offset | |
|---|---|---|---|---|---|---|---|---|
| Type of paper | Untrt. | Trt. | Untrt. | Trt. | Untrt. | Trt. | Untrt. | Trt. |
| pH | 4.85 | 8.0 | 5.2 | 8.2 | 4.80 | 8.2 | 5.4 | 8.4 |
| Acidity | 24 meq /Kg | — | 38 meq /Kg | — | 20 meq /Kg | — | 36 meq /Kg | — |
| % ZnO | — | 2.68 | — | 2.99 | — | 3.28 | — | 3.69 |

It can be seen from these data that a substantial alkaline reserve of zinc oxide has been built up on the papers, ranging from 2.68 to 3.69%, and the pH has been raised to the level of 8.0 to 8.4, a highly desirable result.

Although the preferred method of this invention is to use the metal alkyl in vapor form, the compounds may be applied by dipping or spraying in an organic solvent.

EXAMPLE 7

"Writing Paper, suitable for Offset, G.P.O. No. 21056 and Property 6926, 4.4 lbs. per 500, 8 × 10½ inch sheets were soaked for 10 minutes in a 15% solution of diethylzinc in heptane. The sheet was then drained under nitrogen and following this exposed to room conditions. There was a small temperature rise, approximately 1° C, as the diethylzinc hydrolyzed. The paper was air dried and stored for two weeks. Samples were then exposed for 12 days in the 100° C dry oven. This gives aging equivalent to 100 years under ambient conditions. Samples were also exposed for 12 days in the 90° C, 50% relative humidity oven to check the effect of moisture vapor which is, of course, present in normal aging.

The paper samples were conditioned according to TAPPI standards and tested for pH, brightness and MIT folding endurance. The results are shown in Tables IX and X.

TABLE IX

| | pH | Brightness | Folding Endurance (½ kg) |
|---|---|---|---|
| Control | 6.8 | 70 | 345 |
| Control 12 days 100° C oven | 5.0 | 60 | 12 |
| Control 12 days 90° C, 50%R.H. | 4.6 | 61 | 14 |

TABLE X

| | | | |
|---|---|---|---|
| As treated | 7.6 | 68 | — |
| As treated, 12 days 100 ° C oven | 6.9 | 62 | 120 |
| As treated, 12 days humid oven | 7.1 | 56 | 200 |

The treatment has, as can be seen from the tables, kept the pH around neutral during the aging period. Brightness has dropped somewhat but is not seriously down. Folding endurance is made 10 times better by the treatment in the dry oven sample and 14 times better for the humid oven sample.

The results were slightly better for the humid oven. This will be observed to be true in the subsequent examples. Evidently the moisture film present on the fiber allows the acid present to migrate to the metal oxide for neutralization. This cannot happen so readily in the dry oven.

EXAMPLE 8

The procedure of example 7 was repeated using 7.5% diethylzinc in heptane for dipping the paper. The results are shown in Table XI.

TABLE XI

| | pH | Brightness | Folding Endurance (½ kg) |
|---|---|---|---|
| As treated | 7.8 | 71 | — |
| As treated, 12 days 100° C oven | 7.1 | 64 | 104 |
| As treated, 12 days humid oven | 7.1 | 60 | 134 |

The results in Table XI are to be compared to those of the control in Table IX. Again, the treatment has held the pH around neutral although the control went acid in the ovens. Folding endurance is 8.7 times better than the control in the dry oven samples and 9.6 times better in the humid oven samples.

EXAMPLE 9

The procedure of example 7 was repeated, dipping the paper in a 3.7% solution of diethylzinc in heptane. The results are shown in Table XII.

TABLE XII

| | pH | Brightness | Folding Endurance (½ kg) |
|---|---|---|---|
| As treated | 7.8 | 69 | — |
| As treated, 100° C oven | 7.3 | 64 | 97 |
| As treated, 90° C, 50% RH oven | 7.2 | 60 | 159 |

Even the lower amount of diethylzinc has satisfactorily deacidified and buffered the papers. The pH has again been held at neutrality during oven aging, in contrast to the control which went to the acid side. Brightness of the treated samples is quite satisfactory. Folding endurance is 8 times that of the conrol for the 100° C oven and 11 times that for the humid oven.

EXAMPLE 10

The experiment of example 7 was repeated using 3.7% diethylzinc in heptane and newsprint. Results are shown in Tables XIII and IVX.

TABLE XIII

| | Newsprint | | |
|---|---|---|---|
| | pH | Brightness | Folding Endurance (½ kg) |
| Control | 6.6 | 52 | 39 |
| Control, 100° oven | 4.5 | 37 | 2 |
| Control, humid oven | 4.2 | 35 | 1 |

TABLE IVX

| | Newsprint | | |
|---|---|---|---|
| As dipped | 8.0 | 59 | — |
| As dipped, 100° C oven | 7.3 | 43 | 3 |
| As dipped, humid oven | 7.2 | 46 | 73 |

Again, the lower concentration of diethylzinc has kept the samples neutral over the oven aging period. Brightness, in this experiment, is substantially improved over the control. Folding endurance has not been helped in the 100° C dry oven, but in the humid oven a remarkably good effect has been obtained, in which fold is actually almost twice as good as the unaged control.

The 7.5 and 15% solutions of diethylzinc showed similar behavior to the 3.7% with newsprint.

EXAMPLE 11

The procedure of example 7 was repeated, dipping the writing paper of that example into a solution of di-n-butyl magnesium, triethyl aluminum complex at 5% concentration. The results are shown in Table XV.

TABLE XV

| | pH | Brightness | Folding Endurance (½ kg) |
|---|---|---|---|
| As treated | 8.6 | 70 | — |
| As treated, 100° C oven | 9.3 | 62 | 56 |
| As treated, 50% RH, 90° C oven | 7.5 | 62 | 60 |

In this treatment, the pH has risen slightly, but not enough to harm the brightness. Folding endurance improvement over the control in the aging ovens remains good.

The experiment was repeated using higher concentrations of the complex. The 15% solution, in one case, concentrated by migration during drying and scorched the paper during hydrolysis. This was prevented by prehydrolyzing the sample in ethyl alcohol.

What we claim is:

1. A method of deacidifying paper having a cellulosic base comprising impregnating said paper with a solution of an organo-metallic compound capable of being rapidly hydrolyzed to an alkaline material wherein said compound is selected from the group consisting of lower alkyl compounds of lithium, aluminum, magnesium, gallium, zinc, and mixtures thereof, and wherein the solvent for said compound is an organic liquid, unreactive with said organo-metallic compound and non-destructive to inks used on printed matter, and subsequently hydrolyzing said organo-metallic compound to an alkaline material.

2. A method according to claim 1 wherein the organo-metallic compound comprises diethylzinc.

3. A method according to claim 1 wherein the organo-metallic compound comprises di-n-butylmagnesiumtriethylaluminum complex.

4. A method according to claim 1 wherein the organo-metallic compound is present in concentrations of up to 15% in said solution.

* * * * *